US005181608A

United States Patent [19]

Herzog

[11] Patent Number: 5,181,608

[45] Date of Patent: Jan. 26, 1993

[54] PACKAGE FOR SUPPORTING AN UNBUCKLED STRAP-TYPE WRISTWATCH

[76] Inventor: Jack L. Herzog, 5702 Durocher Street, Montreal, Canada, H2V 3Y2

[21] Appl. No.: 861,594

[22] Filed: Apr. 1, 1992

[51] Int. Cl.[5] ..... B65D 85/40

[52] U.S. Cl. ..... 206/301; 206/45.14; 206/566

[58] Field of Search ..... 206/45.13-45.15, 206/45.18, 45.19, 45.34, 301, 566

[56] References Cited

U.S. PATENT DOCUMENTS

| | | | |
|---|---|---|---|
| 2,219,212 | 10/1940 | Sundee | 206/45.19 |
| 2,880,858 | 4/1959 | Persky | 206/45.13 |
| 4,005,775 | 2/1977 | Crosslen | 206/45.18 |
| 4,034,849 | 7/1977 | Zakrajsek | 206/45.18 |
| 4,082,183 | 4/1978 | Sturm | 206/45.19 |
| 4,799,588 | 1/1989 | Trisl | 206/301 |
| 4,830,181 | 5/1989 | Hartman | 206/301 |

*Primary Examiner*—Jimmy G. Foster

*Attorney, Agent, or Firm*—Pollock, VandeSande and Priddy

[57] ABSTRACT

A package for supporting and displaying a strap-type wristwatch includes a substantially C-shaped wristwatch support element having a pair of integral clips disposed adjacent opposite end portions of the support element. A strap-type wristwatch is mounted on the support element by slipping the straps of the watch into the clips to retain and support the wristwatch in place without buckling the straps together.

8 Claims, 2 Drawing Sheets

PACKAGE FOR SUPPORTING AN UNBUCKLED STRAP-TYPE WRISTWATCH

BACKGROUND OF THE INVENTION

The present invention relates to packages or boxes for wristwatches, and is more particularly concerned with wristwatch support members that can be used in such packages to support and display a strap-type wristwatch without requiring that the straps of the watch be buckled together.

Wristwatch support and display packages have been suggested heretofore which include generally C-shaped support members that can be embraced by a continuous flexible watch band to support the watch in place. Packages of this type are shown and described, for example, in Beauchamp U.S. Pat. No. 4,216,858 and Hartman U.S. Pat. No. 4,830,181. When such packages are used to support and display a strap-type wristwatch, however, the straps must be buckled together to provide the continuous strap configuration needed to embrace the C-shaped support member in the package. This gives rise to a number of disadvantages, namely (a) if the straps are of leather or the like, after the straps have been buckled together a buckle mark is left on non-buckle one of the straps, (b) in order to properly mount the watch in the package, it is necessary to buckle the straps together which requires time and labor, and (c) when a watch is to be shown to a customer at the retail level, the sales person has to unbuckle the watch to remove it from the package, which again involves the expenditure of time and labor, and (d) if the sales person does not thereafter bother to rebuckle the watch straps before returning the watch to the package, as often occurs, the watch is returned in a loose, i.e., unsupported condition to the package, with attendant risk of being damaged as it shifts in position within the package.

The present invention is intended to obviate the foregoing problems by the provision of a package, and more particularly a watch support member for a wristwatch package, that can retain and support a strap-type wristwatch for display without requiring that the straps of the wristwatch be buckled together.

SUMMARY OF THE INVENTION

The wristwatch box or package of the present invention includes a wristwatch support member whose general configuration is similar to that described in the aforementioned Beauchamp and Hartman patents, modified however to incorporate strap retaining means that are integral with the wristwatch support member. The strap retaining means comprise a pair of clips that are fixedly positioned in overlying spaced relation to opposite end portions of a substantially C-shaped element in the watch support member. The resultant arrangement permits a strap-type wristwatch to be mounted on the support member by simply slipping the straps of the watch into the spaces between the clips and the underlying end portions of the C-shaped element thereby to retain and support the wristwatch on the support member without having to buckle the straps together.

The aforementioned Hartman patent contemplates, in certain embodiments, the provision of a removable clip that is used to hold a continuous band wristwatch on a support member when the watch would otherwise tend to fall off of the support member due to the diameter of the continuous watch band being greater than that of the support member. The watch holder and associated removable clip structure contemplated by Hartman is more complex than the structures of the present invention, and more expensive to manufacture. Moreover, although Hartman does not suggest that the removable clip structure could be used with a strap-type watch, if such removable clips were nevertheless used with such a watch the advantages of the present invention would not be achieved since the need to apply and remove the removable clips would involve the expenditure of even more time and labor than would be required to simply buckle and unbuckle the straps of the watch.

In contrast to the Hartman arrangement, the watch support structure of the present invention utilizes non-removable clips that are integral with the wristwatch supporting member, e.g., the watch support member and clips can comprise portions of a plastic element that is molded as a single unit, thereby avoiding problems that might otherwise arise due to the loss or misplacing of removable clips. The provision of such integral clips instead of removable clips makes it far easier to mount a strap-type wristwatch on the support member, and to remove such a watch from the support member, by the simple expedient of slipping the straps of the watch into or out of the clips.

BRIEF DESCRIPTION OF THE DRAWINGS

The foregoing objects, advantages, construction and operation of the present invention will become more readily apparent from the following description and accompanying drawings wherein.

DESCRIPTION OF THE PREFERRED EMBODIMENTS

Figure 1:
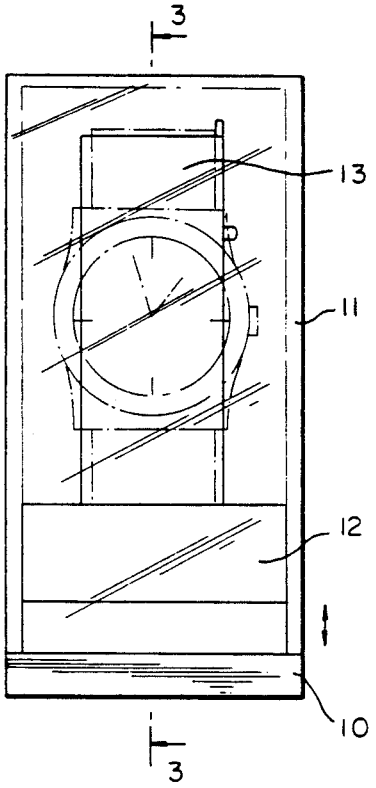
FIG. 1 is a front view of a wristwatch package constructed in accordance with a first embodiment of the present invention.

Each of the embodiments of the present invention utilizes a generally C-shaped support member that incorporates, or is associated with, fixed position clips used to retain in place the straps of a strap-type wristwatch. The C-shaped member includes, in each case, an elongated substantially flat central segment that merges at opposing ends into a pair of end portions that are positionally displaced from the central segment. The end portions may each be curved, and they may have different curvatures as shown for example in FIGS. 3 and 4, or like curvatures as shown for example in FIG. 8. Instead of exhibiting the marked curvature shown in the aforementioned figures, or curvatures of substantially like extent as shown in these figures, the positionally displaced end portions of the C-shaped element may exhibit little if any curvature, and may be of significantly different extents, as shown for example in FIG. 6. Moreover, the different end portion configurations shown in the several embodiments of the present invention are interchangeable from one embodiment to another, as are the various different clip configurations shown in these embodiments an described hereinafter. Each of the embodiments is thus subject to considerable structural variation without departing from the basic concepts of the present invention.

FIGS. 1–4 depict a first embodiment of the invention comprising a base 10 that is adapted to receive a box-like cover 11 fabricated, for example, of a transparent plastic material that permits the contents of the package to be viewed while the cover 11 is seated on base 10. The base 10 is integrated with a wristwatch support member 12 that includes a generally C-shaped support element 13 having an elongated central segment 13*a* merging at its opposing ends into a pair of end portions 13*b* and 13*c*. The C-shaped element 13 is integrated with base 10, and more particularly with member 12, by a web 14 that extends between member 12 and one side of end portion 13*e*. Base 10, support member 12, the C-shaped support element 13 and web 14 may comprise different integral portions of a plastic member molded as a single unit. This same unitary plastic molding approach may be employed, moreover, in each of the other embodiments of the present invention to be described hereinafter.

Figure 3:
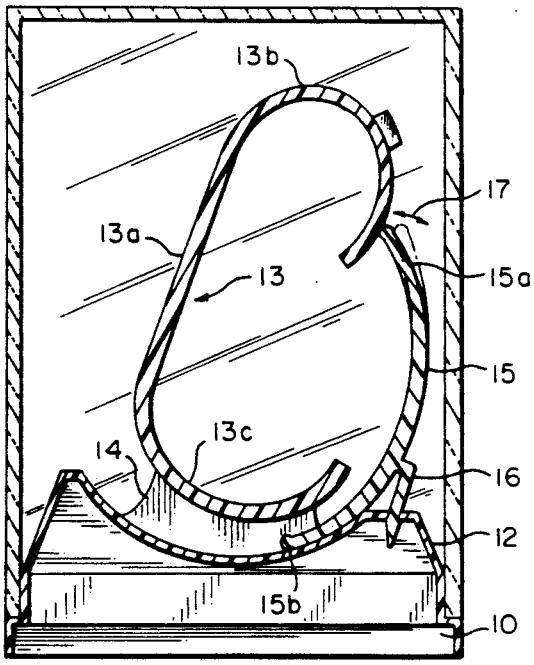
FIG. 3 is a side view of the package taken on line 3—3 of FIG. 1
Figure 4:
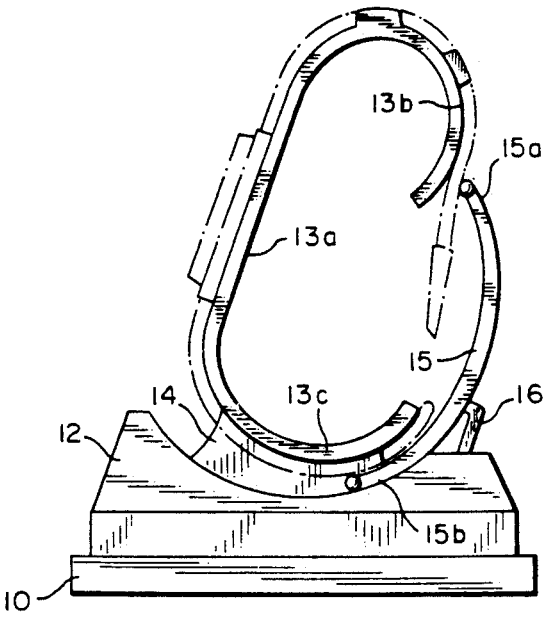
FIG. 4 is a side view of the wristwatch support member used in the embodiment of FIGS. 1–3, showing how that support member is used in practice.

As best shown in FIGS. 3 and 4, the free ends of end portions 13*b* and 13*c* are spaced from one another. An elongated strap retaining member 15 extends in a direction generally parallel to the elongated central segment 13*a* of the C-shaped support element 13 and is affixed to support member 12 by a flexible plastic spring element 16 that is attached to member 12 by an appropriate adhesive or which, in the alternative, can comprise another portion of the aforementioned unitary molding together with member 15. The strap retaining member 15 extends across the space between the free ends of end portions 13*b*, 13*c*, and has its opposing ends 15*a* and 15*b* disposed in facing relation to the end portions of the C-shaped element 13. The strap retaining member 15 is positioned outwardly of the C-shaped element 13, and is so positioned that one or both of its ends 15*a* and 15*b* are in initial contact with, or in the alternative one or both of its ends are initially spaced from, end portions 13*b* and 13*c* of C-shaped element 13. The strap retaining member 15 and C-shaped element 13 can be flexibly displaced relative to one another, e.g., as depicted by arrow 17 and the adjacent broken line configuration of end 15*a* in FIG. 3. By reason of this arrangement, end 15*a* of strap retaining member 15 cooperates with the facing end 13*b* of support element 13 to provide a first fixed position resilient clip therebetween, and the opposite end portions 13*c* and 15*b* of elements 13 and 15 similarly cooperate with one another to provide a second fixed position resilient clip that is spaced from the first clip.

Figure 2:
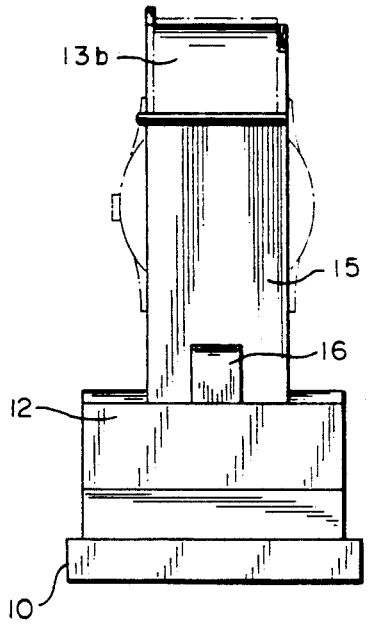
FIG. 2 is a rear view of the package shown in FIG. 1, with the cover removed.

A strap-type wristwatch, shown in broken line in FIGS. 1, 2 and 4, may be supported for display on the C-shaped support element 13 in the manner best shown in FIG. 4. More particularly, the watch itself is placed on the elongated central segment 13*a*, its two straps are then extended around the end portions 13*b* and 13*c* respectively, and the free ends of the straps are slipped into the two clips, i.e., between elements 15*a*, 13*b* and 15*b*, 13*c*. The resilience of the clips provided by these facing elements holds the watch and its associated straps in place on the C-shaped element without requiring that the watch strap be buckled together.

Figure 5:
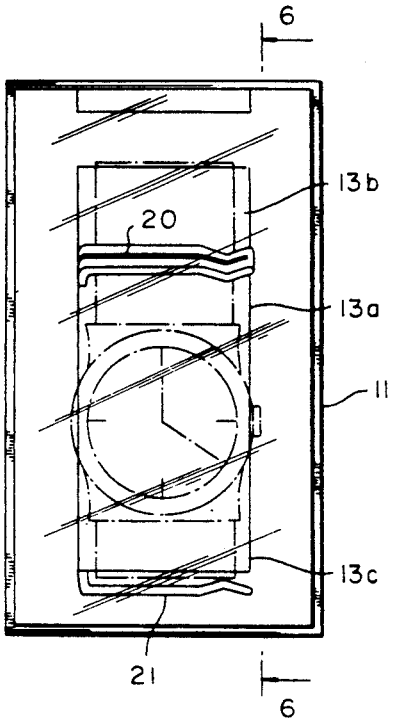
FIG. 5 is a top view of a wristwatch package constructed in accordance with a second embodiment of the present invention.
Figure 6:
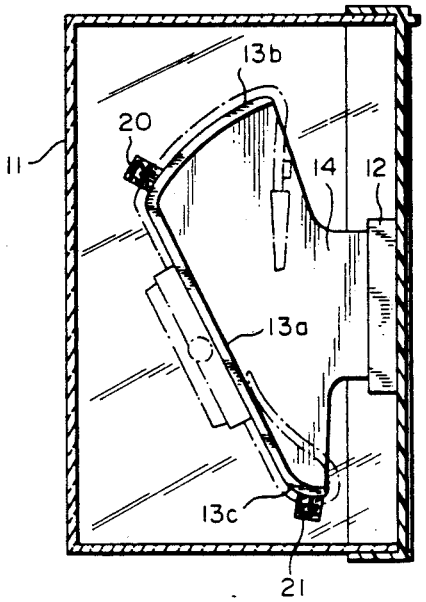
FIG. 6 is a side view of the second embodiment taken on line 6—6 of FIG. 5.

A second embodiment of the invention is shown in FIGS. 5 and 6. Elements which correspond to those already described with reference to FIGS. 1–4 are given like numerals in FIGS. 5 and 6, even though the specific configurations of those elements differ from one embodiment to the other.

In the embodiment of FIGS. 5 and 6, a pair of clips are again formed adjacent the end portions 13*b* and 13*c* of the C-shaped support element 13. In this embodiment, however, the two clips are formed by a pair of elongated members 20, 21 that are molded as integral portions of the C-shaped support element and extend respectively from side edges of the end portions 13*b*, 13*c* across said end portions in directions that are transverse to the direction of elongation of the central segment 13*a* of the C-shaped support element. The clip formed by member 20 is located at a position between central segment 13*a* and a free end of end portion 13*b*, whereas the clip formed by member 21 is disposed closely adjacent to the free end of end portion 13*c*.

A strap-type watch is supported on the C-shaped element in the manner shown in FIG. 6, i.e., in a manner that is analogous to that described in reference to FIG. 4. The positions that are assumed by the ends of the straps beyond clips 20 and 21 will depend upon the materials of which those straps are fabricated, and the positions of the strap ends depicted in broken line in FIG. 6 have been so depicted simply to facilitate the placement of numerals in that figure. The C-shaped element of the embodiment shown in FIGS. 5 and 6 is less upright than the embodiment of FIGS. 1–4, and therefore a watch supported on the element is viewed primarily through the top of the transparent cover 11 as shown in FIGS. 5 and 6, rather than through an end of the cover as shown in FIG. 1.

Figure 7:
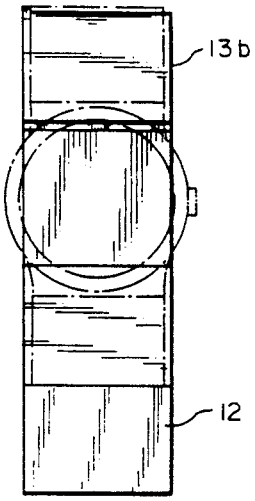
FIG. 7 is a front view of a wristwatch support member constructed in accordance with a third embodiment of the present invention.
Figure 8:
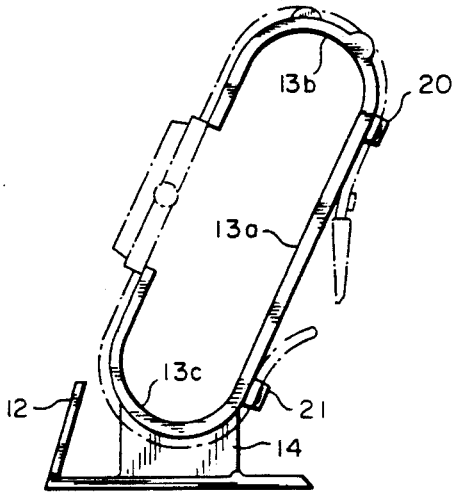
FIG. 8 is a side view of the third embodiment.
Figure 9:
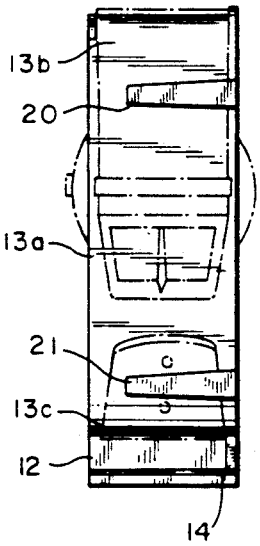
FIG. 9 is a rear view of the third embodiment.

FIGS. 7–9 depict a wristwatch support element that may be used in a third embodiment of the invention. Portions of the structure shown in this further embodiment that correspond to portions of the previously described embodiments have again been identified by like numerals. In the embodiment of FIGS. 7–9, the C-shaped support element is more upright, i.e., in much the same manner as the embodiment shown in FIGS. 1–4, but it is inclined in a direction opposite to that of the embodiment of FIGS. 1–4 so that the watch itself is located between the free ends of end portions 13*b*, 13*c* opposite to, rather than along, central segment 13*a* of the support element. The integral clip members 20, 21 again extend from a side edge of the C-shaped support element in directions transverse to the direction of elongation of central segment 13*a*, but have a configuration that is different from that of the elements 20, 21 shown in FIG. 5. Moreover the clip elements 20, 21 in the third embodiment may be disposed adjacent the substantially flat central segment 13*a*, as depicted for example in FIG. 8, rather than adjacent the curved end portions of the C-shaped support element.

Having thus described my invention I claim:

1. A package for supporting and displaying a strap-type wristwatch that has a pair of straps, adapted to be buckled together when worn on the wrist of a user, without requiring that said straps be buckled together for purposes of such support and display in the package, said package including a wristwatch support member that comprises a substantially C-shaped element having an elongated central segment terminating in opposite end portions that are positionally displaced from said central segment, and strap retaining means integral with said wristwatch supporting member comprising a pair of flexible clips fixedly positioned in overlying relation to spaced portions of said C-shaped element adjacent said opposite end portions of said element, a strap-type wristwatch being held in position on said wristwatch support member by slipping the straps of the watch into said clips to retain the wristwatch on said support member without buckling the straps together.

2. The package of claim 1 wherein said central segment is substantially flat, each of said end portions is curved, and each of said clips includes a member that is integral with an associated one of said end portions and extends from a side edge of its associated end portion across at least a portion of said associated end member in a direction transverse to the direction of elongation of said central segment.

3. The package of claim 1 wherein at least one of said clips is disposed at a free end of one of said end portions.

4. The package of claim 1 wherein said central segment is substantially flat and at least one of said end portions is curved, at least one of said clips being disposed adjacent said curved end portion at a position between said central segment and a free end of said curved end portion.

5. The package of claim 1 wherein said substantially C-shaped element and said clips comprise integral portions of a plastic member molded as a single unit.

6. The package of claim 1 wherein at least one of said clips comprises an elongated member that is integral with a side edge of said C-shaped element and extends from said side edge across said C-shaped element in a direction transverse to the direction of elongation of said central segment.

7. The package of claim 6 wherein said elongated member extends across at least a portion of said central segment and is flexibly displaceable relative to said central segment.

8. The package of claim 1 wherein said end portions have free ends that are spaced from one another, said strap retaining means comprising an elongated member extending in a direction generally parallel to said elongated central segment across the space between said free ends of said end portions, said elongated member having a pair of ends that respectively face said end portions of said C-shaped element, the ends of said elongated member and said end portions of said C-shaped element being flexibly displaceable relative to one another and cooperating to form said pair of clips.

* * * * *